US005622224A

United States Patent [19]

Yates

[11] Patent Number: 5,622,224

[45] Date of Patent: Apr. 22, 1997

[54] METHOD AND APPARATUS FOR CEMENTING WELL CASING USING ALTERNATE FLOW PATHS

[75] Inventor: Tommy J. Yates, Coppell, Tex.

[73] Assignee: Mobil Oil Corporation, Fairfax, Va.

[21] Appl. No.: 493,223

[22] Filed: Jun. 20, 1995

[51] Int. Cl.[6] ..... E21B 33/14

[52] U.S. Cl. ..... 166/285; 166/242.3

[58] Field of Search ..... 166/285, 289, 166/242.3, 242.9

[56] References Cited

U.S. PATENT DOCUMENTS

| | | | |
|---|---|---|---|
| 56,234 | 7/1866 | Latham | 166/242.3 |
| 3,194,312 | 7/1965 | Thomas | 166/285 |
| 4,787,450 | 11/1988 | Andersen et al. | 166/285 X |
| 4,909,323 | 3/1990 | Hastings | 166/289 |
| 4,945,991 | 8/1990 | Jones | 166/278 |
| 5,082,052 | 1/1992 | Jones et al. | 166/51 |
| 5,113,935 | 5/1992 | Jones et al. | 166/51 |
| 5,161,613 | 11/1992 | Jones | 166/242 |
| 5,161,618 | 11/1992 | Jones et al. | 166/308 |
| 5,339,901 | 8/1994 | McKinzie | 166/289 |
| 5,419,394 | 5/1995 | Jones | 166/242.3 |

FOREIGN PATENT DOCUMENTS

| | | | |
|---|---|---|---|
| 2134947 | 8/1984 | United Kingdom | 166/285 |

*Primary Examiner*—Hoang C. Dang
*Attorney, Agent, or Firm*—Malcolm D. Keen

[57] ABSTRACT

A method and apparatus for casing and cementing an interval of a well bore which provide for a good distribution of cement over the entire interval even when a restriction forms within the annulus before all of the cement has been placed. The casing is provided with an alternate flow path for delivering cement slurry which flows from the lower end of the casing to different levels within the well annulus so that if a restriction occurs in the annulus, cement slurry can still be delivered to the annulus above the restriction.

3 Claims, 2 Drawing Sheets

METHOD AND APPARATUS FOR CEMENTING WELL CASING USING ALTERNATE FLOW PATHS

DESCRIPTION

1. Technical Field

The present invention relates to a method and apparatus for cementing a casing in a wellbore and in one of its aspects relates to a method and apparatus for cementing a casing in a wellbore wherein an alternate flowpath(s) is used to provide good distribution of cement throughout the annulus between the casing and the wellbore even where a restriction may form in said annulus during the placement of the cement.

2. Background

After drilling a well of the type used in hydrocarbon production, typically a string of casing is positioned in the wellbore and a calculated amount of cement slurry is pumped down the casing, out a "shoe" on the bottom of the casing, and up through the annulus which is formed between the wellbore and the casing. As the cement slurry flows down the casing and up through the annulus, it pushes the wellbore fluids (e.g. drilling mud) ahead of it out of the casing and up through the annulus to the surface.

After all of the calculated amount of cement has been pumped into the well, it is routinely followed by a liquid (e.g. mud or water) which, in turn, displaces substantially all of the cement remaining in the casing into the annulus to finish filling the desired length of the annulus around the casing. As will be understood in this art, the cement slurry and the respective fluids are normally separated by special fluid spacers and/or rubber wiper plugs as they are pumped down the casing. If the cementing operation is successful, the desired interval or length of the well annulus between the wellbore and the casing will be filled with a relatively-uniform cement sheath which is then allowed to cure to support the casing within the wellbore and to effectively block flow through the annulus between the formations or zones which lie behind the casing.

Unfortunately, problems often arise in cementing casing in some wellbores due to the fact that flow of the cement slurry through the annulus may become impeded or blocked at some point(s) within the annulus before the placement of the slurry has been completed. For example, a restriction(s) may form in the annulus during the cementing operation which will block or partially block flow of the cement. Such restriction(s) may result from a variety of causes, e.g. (a) premature dehydration of the cementing slurry which occurs when the formation absorbs too much water from the cement slurry causing it to thicken and set before placement is complete; (b) "channeling" which occurs when all of the drilling fluid is not displaced from the wellbore prior to placement of the cement slurry: (c) partial wellbore collapse; (d) formation swelling and sloughing which is usually caused by loss of water to swellable clays and unstable shale intervals; and (e) trash or debris accumulating in the annulus.

The formation of such restriction(s) will routinely prevent the proper distribution of cement throughout the annulus interval to be cemented. For example, the normal flow of cement slurry will be blocked and will have difficulty in by-passing the restriction with the result being that only the annulus below the restriction will be adequately filled with cement. When this occurs, as will be understood in the art, very expensive and time-comsuming measures have to be taken (1) to complete the filling of the annulus above the restriction and (2) in removing the column of cement which remains blocked in the casing with no place to go. In the most extreme cases, the well may even have to be abandoned and redrilled.

SUMMARY OF THE INVENTION

The present invention provides a method and apparatus for casing and cementing an interval of a well bore which provide for a good distribution of cement over the entire interval even when a restriction forms within the annulus before all of the cement has been placed. Basically, an alternate flow path is provided for delivering up-flowing cement slurry to different levels within the well annulus so that if a restriction does occur, cement can still be delivered to the annulus above the restriction.

More specifically, in accordance with the present invention, a normal string of casing which is to be cemented into a wellbore is modified to include at least one "alternate flowpath" (e.g. perforated shunt conduit) which, in turn, extends substantially parallel to the longitudinal axis of the casing. In one embodiment, the lower end of the shunt conduit lies near or adjacent the bottom of the casing and is open to flow. The shunt conduit may extend through the entire interval to be cemented or it may only extend to above that point at which a restriction(s) in the annulus may be expected to occur (e.g. adjacent the uppermost "weak zone" in the wellbore). The shunt conduit has a plurality of outlets spaced at intervals along its length for delivering cement slurry to different levels within the annulus.

In a further embodiment, one or more relatively short shunt conduits are spaced along the casing and are positioned to lie adjacent to and extend through all of the identified, "weak zones" when the casing is in position within the wellbore. These shunt conduits may be perforated to deliver cement slurry to different levels above the restriction or they merely be open at their upper ends to allow cement to flow into the annulus above the restriction.

In operation, the casing and the shunt conduit(s) are made-up (e.g. spot-welded together) and lowered into the wellbore. The cement slurry is pumped down the casing and up through the annulus. If a restriction forms in the annulus, cement slurry will continue to flow through a respective shunt conduit and out through the outlets therein to enter the annulus at different levels, i.e. those levels which lie above the restriction. This allows the flow of cement slurry to by-pass the restriction in the annulus and thereby complete the filling of that portion of the annulus which lies above the restriction.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
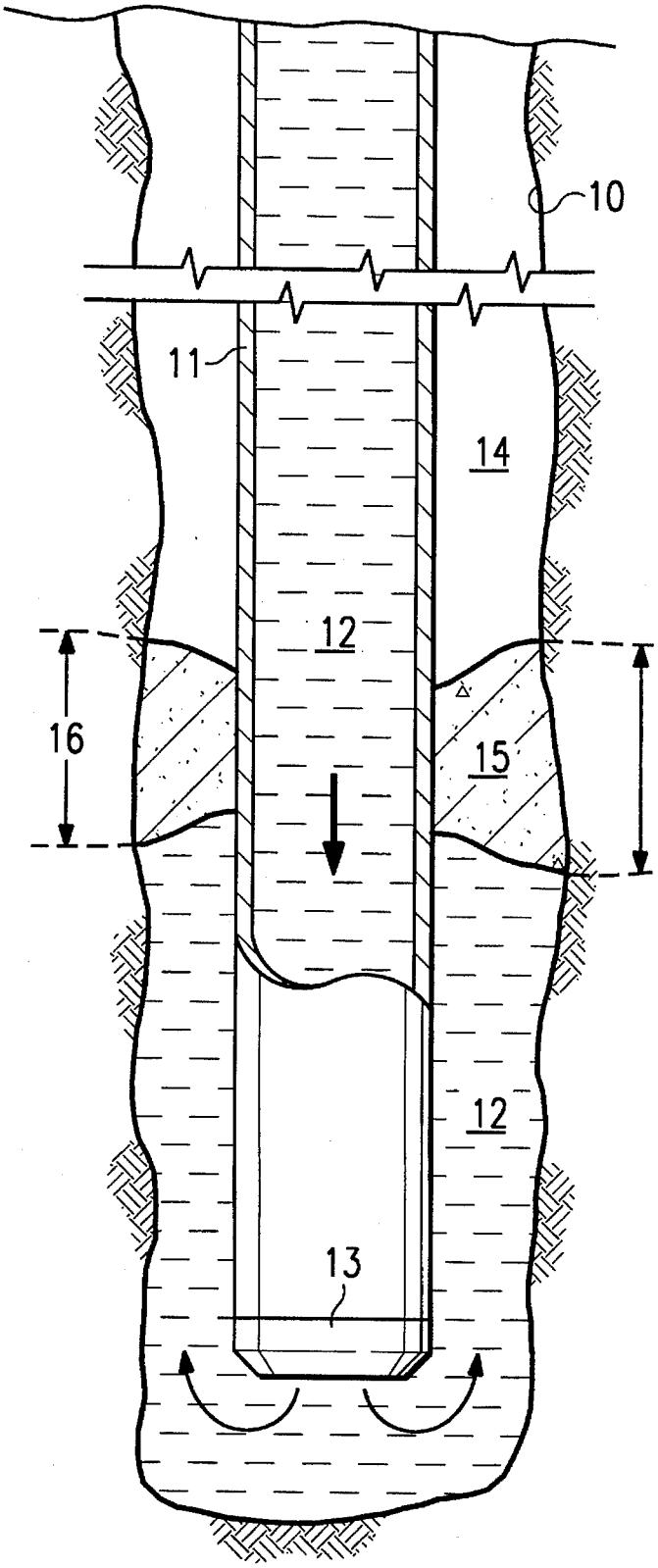
FIG. 1 (PRIOR ART)
FIG. 1 is a sectional view, partly in section, of the lower end of a wellbore in which a casing is being cemented in accordance with prior art procedures.

Referring more particularly to the drawings, FIG. 1 illustrates the lower end of a wellbore 10 wherein a string of casing 11 is being cemented by using known, prior art cementing techniques. Casing 11 is positioned within wellbore 10 and cement slurry 12 is pumped down casing 11 and out through a "shoe" 13 or the like which is connected to the bottom of casing 11. The cement slurry 12 flows up through annulus 14 which is formed between wellbore 10 and casing 11. Annulus 14 (i.e. space between wellbore 10 and casing 11) is shown as being somewhat exaggerated in the drawings for the sake of clarity.

As will be understood in the art, the cement slurry 12 pushes the well fluids (e.g. drilling fluid, not shown) which are normally present in casing 11 and annulus 14 ahead of it as slurry 12 is pumped down casing 11 and out into annulus 14. After the calculated volume (i.e. volume calculated to fill a desired length of annulus 14) has been pumped into casing 11, a displacement fluid (e.g. water, drilling mud, etc., not shown) is pumped into casing 11 behind cement slurry 12 to displace the slurry out of the casing 11 and into the annulus to complete the filling of the annulus interval to be cemented and to keep flow through casing 11 open. Of course, appropriate known spacers (not shown) are normally used to separate the various fluids as they are pumped through casing 11 as is common in most cementing operations of this type.

If the cementing operation is completely successful, substantially all of the cement slurry 12 will be pumped out of casing 11 and will completely fill the interval of annulus 14 which is to be cemented. Unfortunately, however, in many wells of this type, a restriction 15 or the like can occur in annulus 14 before all of the cement slurry 12 has been placed in the annulus. Such restrictions can occur due to a variety of causes such as those enumerated above. As illustrated, restriction 15 is formed adjacent a "weak zone" 16, e.g. a xone which quickly absorbs water from the cement slurry 12 thereby prematurely dehydrating the slurry which causes the cement to thicken and set within the annulus.

When a restriction 15 forms within annulus 14, further flow of cement slurry 12 through the annulus is effectively blocked thereby bringing the cement operation to a premature halt. When this happens, not only is annulus 14 above restriction 15 inadequately filled with cement but also, a column of cement slurry remains trapped in casing 11. As recognized by skilled in this art, when this happens, substantial time and expense is required to complete the cement job and to clean out casing 11, if such completion is possible at all.

Figure 2:
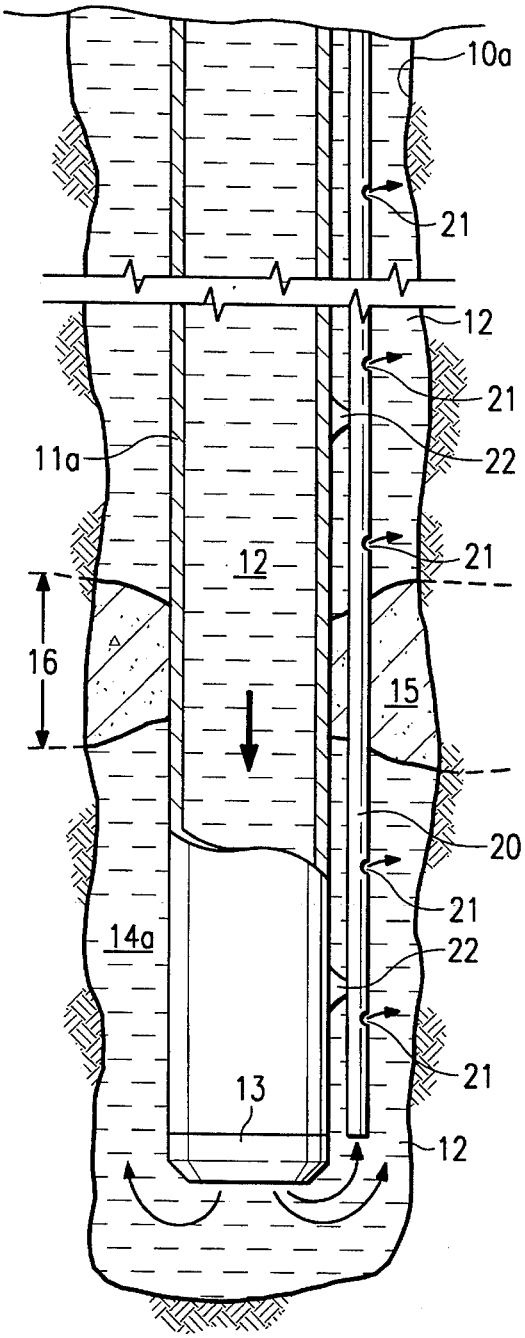
FIG. 2 is a sectional view, partly in section, of the lower end of a wellbore in which a casing is being cemented with one embodiment of the present invention.

Now referring to FIG. 2, casing 11*a*, which has been modified in accordance with one embodiment of the present invention, is positioned with the wellbore 10*a*. Casing 11*a* includes at least one "alternate flowpath" (e.g. perforated shunt conduit 20) which extends substantially parallel to the longitudinal axis of the casing. While only one conduit 20 is shown, it should be understood that additional shunt conduits 20 could be radially-spaced around casing 11 , if desired or required, without departing from the present invention.

The lower end of conduit 20 lies near or adjacent the bottom of casing 11*a* (e.g. shoe 13) and may extend through the entire interval to be cemented or it may only extend up through the uppermost "weak zone(s)" 16, if such zones can be reliably identified from well logs or the like. Shunt conduit 20, which is open to flow at its lower end, has a diameter (e.g. 1 inch) sufficient to easily convey cement slurry 12 and preferably has a plurality of outlets 21 which are spaced at intervals along its length for delivering cement slurry to different levels within the annulus.

In operation, casing 11*a* and shunt conduit 20 are made-up and lowered into wellbore 10*a*. As the casing and the shunt conduit are made-up, conduit 20 can be physically connected to casing 11*a* by any appropriate means (e.g. spot welds 22). Cement slurry 12 is pumped down casing 11*a*, out shoe 13, and into the bottom of annulus 14*a*, displacing the well fluids ahead of it in the same manner as described above in relation to prior art cementing operations. The cement slurry flows up through and fills annulus 14*a* in the same way as before except now, if a restriction 15 forms in annulus 14*a*, cement slurry 12 will continue to flow through conduit 20 and out outlets 21 at different levels in the annulus, including those above restriction 15. This allows the flow of cement slurry 12 to by-pass restriction 15 to complete the filling of that portion of annulus 14*a* which lies above restriction 15 thereby providing good distribution of cement slurry over the entire interval of annulus 14 which is to be cemented.

Figure 3:
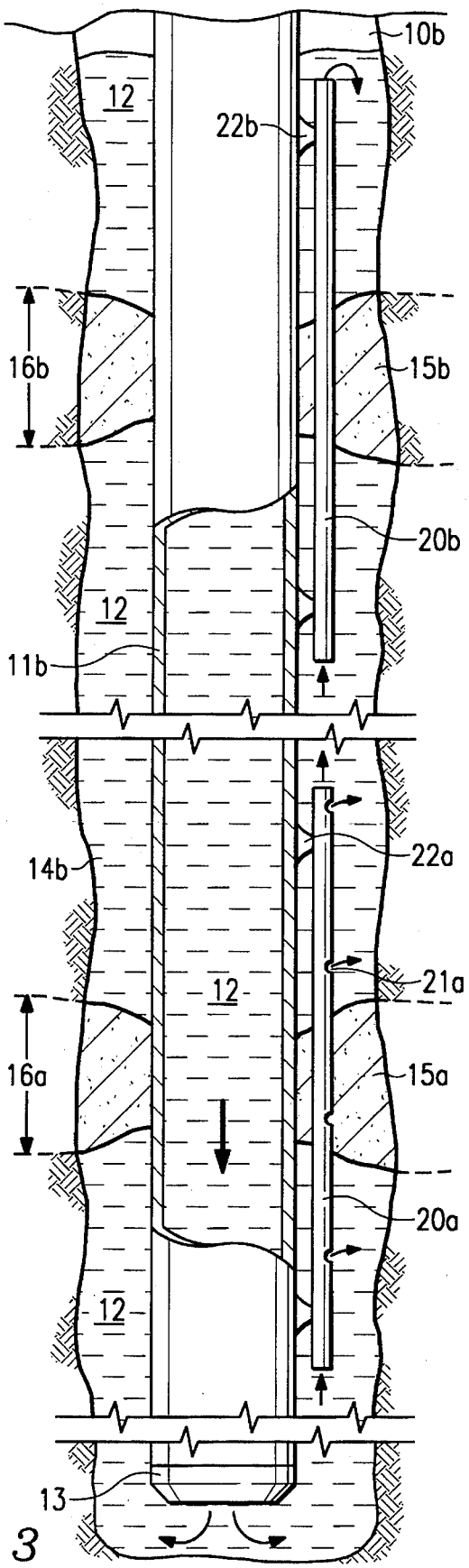
FIG. 3 is a sectional view, partly in section, of the the lower end of a wellbore in which a casing is being cemented with a further embodiment of the present invention.

Referring now to FIG. 3, a further embodiment of the present invention is shown wherein casing 11*b* includes one or more relatively, short shunt conduits 20*a*, 20*b* (only two shown) which are secured to the casing (by spot welds 22*a*, 22*b*, respectively, or the like) parallel to and spaced along casing 11*b*. For example, shunt conduits 20*a*, 20*b*, which are open at both ends, are positioned so that they will extend through "weak zones" 16*a*, 16*b*, respectively, when casing 11*b* is in position within wellbore 10*b*.

The shunt conduits may be perforated to provide outlets 21*a* at spaced intervals (e.g. 20*a*) or may have only one outlet at their upper end (e.g. 20*b*). Now if a restriction (e.g. 15*a* and/or 15*b*) form in the annulus before the cementing operation is complete, cement slurry 12 can continue to flow upward in annulus 14*b* through shunt conduits 15*a* and/or 15*b* to complete the distribution of cement over the entire interval of the annulus to be cemented.

What is claimed is:

1. Apparatus for cementing a casing and cementing an interval of a wellbore, said apparatus comprising:

a string of casing open at its lower end positioned within said wellbore to thereby form an annulus between said casing and said wellbore;

a shoe positioned on the open lower end of said string of casing through which a cement slurry can flow from said casing into said annulus; and an alternate flowpath within said annulus for delivering cement slurry from the bottom of said annulus to different levels within said annulus; said alternate flowpath comprising:

at least one conduit attached to said string of casing and extending substantially parallel to the longitudinal axis of said casing and extending at least through a zone within said interval where a restriction to flow is likely to occur during the flow of the cement slurry through said annulus, said conduit being open at its lower end and having a plurality of outlets spaced along its length above said zone.

2. A method for cementing a string of casing in a wellbore, said method comprising:

positioning the string of casing in said wellbore thereby forming an annulus between said casing and said wellbore;

flowing a cement slurry down through and out of the lower end of said casing and up through said annulus; and flowing a portion of said cement slurry up through an alternate flowpath within said annulus to different levels within said annulus, wherein said alternate flowpath comprises:

a conduit positioned within said annulus and having an outlet at each of said different levels within said annulus.

3. Apparatus for cementing a casing and cementing an interval of a wellbore, said apparatus comprising:

a string of casing open at its lower end positioned within said wellbore to thereby form an annulus between said casing and said wellbore;

a shoe positioned on the open lower end of said string of casing through which a cement slurry can flow from said casing into said annulus; and an alternate flowpath within said annulus for delivering cement slurry from the bottom of said annulus to different levels within said annulus; said alternate flowpath comprising:

at least one conduit open at its lower end and attached to said string of casing and extending substantially parallel to the longitudinal axis of said casing and extending from near the bottom of said casing throughout said interval of the annulus to be cemented.

* * * * *